United States Patent [19]

Muller

[11] 4,196,532

[45] Apr. 8, 1980

[54] BALLAST REGULATOR SIDE PLOW

[75] Inventor: Jacques Muller, Echandens, Switzerland

[73] Assignee: Materiel Industriel S.A., Lausanne, Switzerland

[21] Appl. No.: 914,141

[22] Filed: Jun. 9, 1978

[30] Foreign Application Priority Data

Jun. 16, 1977 [CH] Switzerland ..... 7393/77

[51] Int. Cl.[2] ..... E02F 5/22

[52] U.S. Cl. ..... 37/105

[58] Field of Search ..... 37/104, 105, 36; 172/466, 467, 468, 782; 104/10–13

[56] References Cited

U.S. PATENT DOCUMENTS

| | | | |
|---|---|---|---|
| 2,348,796 | 5/1944 | Ferwerda et al. | 37/105 X |
| 2,830,391 | 4/1958 | Bruno et al. | 37/105 |
| 3,237,388 | 3/1966 | Rishovd et al. | 37/105 X |
| 3,257,744 | 6/1966 | Buhler | 37/105 |
| 3,682,101 | 8/1972 | Plasser et al. | 37/105 X |
| 3,726,347 | 4/1973 | Hyman | 37/105 X |
| 3,815,268 | 6/1974 | Yard | 37/105 |
| 4,096,652 | 6/1978 | Raines et al. | 37/105 |

*Primary Examiner*—E. H. Eickholt

*Attorney, Agent, or Firm*—Wenderoth, Lind & Ponack

[57] ABSTRACT

A device for the levelling and profiling of railroad ballast beds has two lateral ploughs, one designed to operate outside each rail. Each lateral plough is identical and comprises a blade connected through a joining member to a main support arm which is movable in a plane substantially perpendicular to the longitudinal axis of the track. The support arm is connected to the chassis of the device by means of a hydraulic jack acting at one point on the arm and a double link connected to a second spaced point on the arm. The hydraulic jack is operable to adjust the height of the blade and a further hydraulic jack is connected to the double link to adjust the lateral position of the blade. The arm is preferably of rectangular cross-section and arranged between two lateral supporting walls of the chassis. The joining member is capable of pivoting action about two mutually perpendicular axes and two further hydraulic jacks are arranged to change the angular position of the joining member in relation to the support arm and the angular position of the blade in relation to the joining member.

3 Claims, 4 Drawing Figures

BALLAST REGULATOR SIDE PLOW

BACKGROUND OF THE INVENTION

The present invention relates to a device for the levelling and profiling of railroad ballast beds, the device having at least one lateral plough associated with one rail and designed to operate outside the rail, the plough blade being adjustable in height in relation to the plane of the track, and being also adjustable in width and angularly in relation to the longitudinal axis of the track.

In known devices of this type, various means for attaching the blade of the lateral plough to the chassis of the mobile device have been tried out, with more or less success, for the purpose of obtaining the aforesaid mobility and adjustments. The problem is actually relatively complex because of the considerable resistance to the progress of the plough-blade offered when the said plough-blade is in cantilever in relation to the chassis of the mobile device, and because of the large number of settings required, from the folded inoperative position to the various extended positions used in levelling and profiling the ballast bed.

According to the known most recent means of attachment, the blade of the lateral plough is hinged, by means of a connecting part comprising two hinge axes at right angles to each other, as in a "cardan joint," to an arm moving transversely of the track on a cross slide integral with the chassis of the mobile device, the slide being stationary in relation to the latter.

With this type of attachment, the plough-blade is adjusted angularly in relation to the longitudinal axis of the track by rotating it about the two hinge axes of the connecting part, in horizontal and vertical planes, while width adjustment is effected by displacement of the arm in its slide.

However, since the said slide is stationary in relation to the chassis of the mobile device, adjustment of the height of the plough blade can be carried out only indirectly by rotating the blade in a vertical plane transversely of the track. This is a disadvantage, since the only way of moving the edge of the blade from a given angular position to an angular position parallel therewith is by moving the arm laterally in its slide, which means altering the distance of the sphere of action of the blade from the axis of the track. Moreover, with this type of attachment it is impossible to adjust the height of the plough blade if the prescribed position of the lower edge thereof is parallel with the arm-slide, since in this case transverse movement of the arm moves the edge of the blade only along its line of action.

In another means of adjustment, in which the plough is adapted to move longitudinally in relation to the chassis of the mobile device, it has been suggested that the arm carrying the blade be mounted on a support moving vertically in a vertical slide integral with the said chassis. With this arrangement, however, the arm supporting the plough blade cannot be moved or adjusted transversely of the track, and the required total mobility in all directions is thus not obtained. Furthermore, superimposing two motions of translation obtained by means of systems using vertical and longitudinal guidance slides, at least one of which is in cantilever, results in a design which is heavy, expensive and subject to rapid wear.

OBJECT OF THE INVENTION

It is the purpose of the present invention to obviate or mitigate the aforesaid disadvantages by using a lateral plough of simple and rugged design which does not use guidance slides, but which provides considerable mobility of the blade, not only by translation in height and width but by pivoting the blade in the plane of the transverse profile of the track.

SUMMARY OF THE INVENTION

According to the present invention, there is provided a mobile device for the levelling and transverse profiling of railroad ballast beds, the device comprising a chassis, at least one lateral plough associated with one rail for operating outside the rail in which the lateral plough comprises a blade, an arm movable in a plane substantially perpendicular to the longitudinal axis of the track and connected to the chassis by at least two connecting links parallel with said plane and pivotally connected at their one ends to two points spaced along the arm and pivotally connected at their other ends to two spaced points on the chassis, one of the two connecting links being in the form of an extensible element adjustable in length and the other of the two connecting links being connected to an element for adjusting the angular position of the other link in relation to the chassis whereby through movement of the two links the height and lateral position of the blade is controllable, the blade being pivotally connected at a third point on the arm by means of a joining member having two pivot axes at right angles to each other, the joining member being connected to an element for adjusting the angular position of the joining member in relation to the arm, and being connected to an element for adjusting the angular position of the blade of the plough in relation to the joining member.

BRIEF DESCRIPTION OF THE DRAWINGS

The invention will now be described in greater detail with reference to the accompanying drawings, in which.

DETAILED DESCRIPTION OF PREFERRED EMBODIMENT

Figure 1:
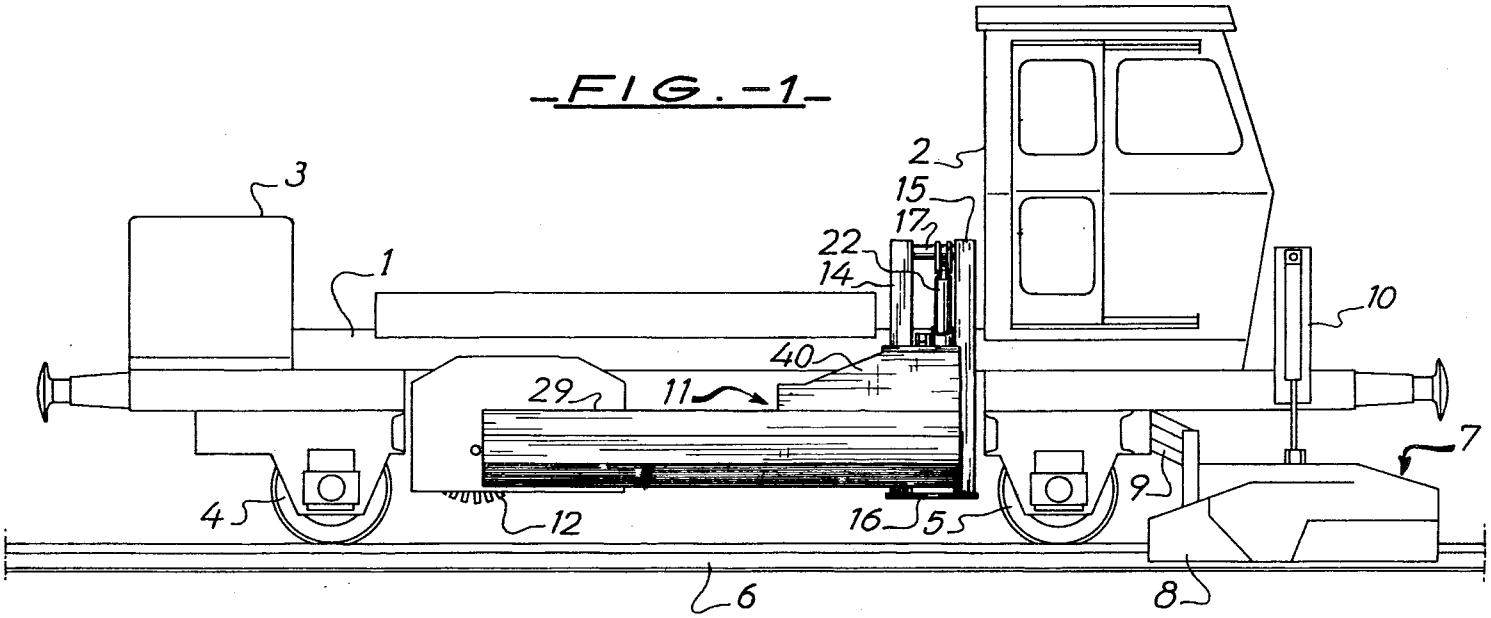
FIG. 1 is a general side elevation of a mobile device equipped with two lateral ploughs.

The mobile device illustrated in FIG. 1 is a self-propelled railroad machine designed to distribute railroad track ballast to provide a prescribed transverse profile. The machine comprises a chassis 1 equipped with a driving and control cabin 2, a propulsion unit 3, and two axles 4,5 shown here resting on rails 6 of a railroad track.

The chassis 1 carries the working tools consisting of a front plough 7, shown here in the operative position and consisting of two independent blades 8 (only one shown) each connected to the chassis by a double hinged arm 9 and a positioning jack 10, two lateral ploughs 11 (only one shown), each associated with one of the rails 6, the characteristic design of the lateral ploughs being described hereinafter, and a rotating brush 12 extending over the full length of the ties supporting the rails 6. Lateral ploughs 11 and brush 12 are shown in the retracted, inoperative position.

These implements are used in known fashion for levelling and transferring ballast from the centre of the track to the shoulders, or vice-versa with front plough 7, for levelling and profiling the sides and shoulders, and for transferring ballast from the shoulders to the work areas of the front ploughs by means of lateral ploughs 11, and for cleaning off the surfaces of the ties and levelling the ballast in the gaps therebetween by means of brush 12.

Figure 2:
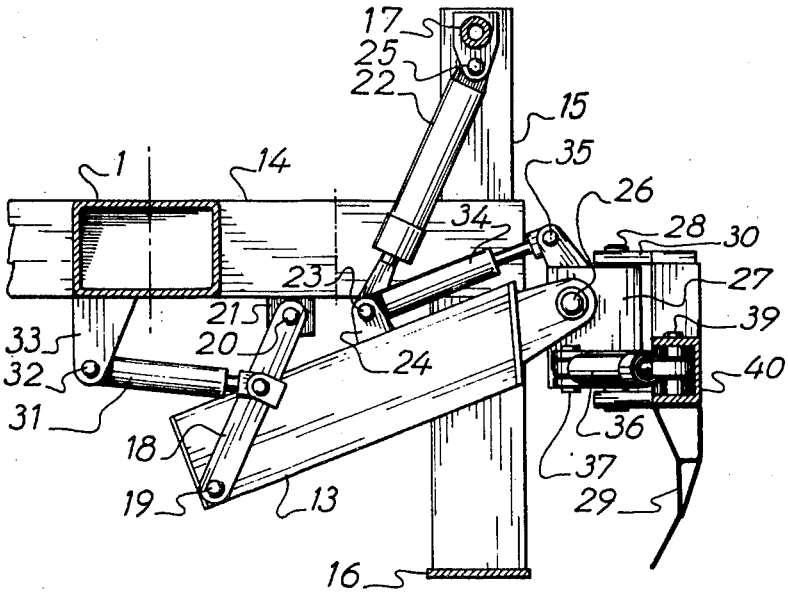
FIG. 2 is a side view taken along line I—I of FIG. 3 and showing to an enlarged scale, the lateral plough illustrated in FIG. 1.
Figure 3:
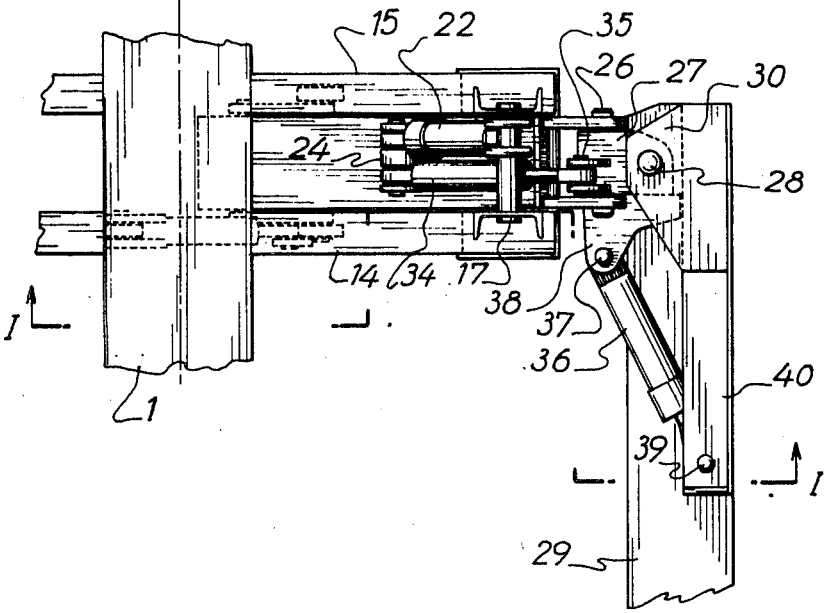
FIG. 3 is a plan view, to the same enlarged scale as FIG. 2, of the lateral plough shown in FIG. 1.

Each lateral plough 11 illustrated in FIGS. 1, 2 and 3, comprises a tubular arm 13 of square cross section running transversely of the track and movable, in a plane substantially perpendicular to the longitudinal axis of the track, between two lateral, symmetrical, T-shaped walls 14, 15 integral with chassis 1 of the machine, the horizontal branches being welded to the chassis and the vertical arms being connected by a plate 16 at their lower ends and a tube 17 at their upper ends.

The lower end of arm 13 is connected to chassis 1 of the machine by a double link 18, the lower ends of which are hinged to two lateral pivot pins 19 on the arm 13, while the upper ends thereof are hinged to two pivot pins 20 carried in plates 21 welded to walls 14, 15 of chassis 1.

A double-acting hydraulic jack 22 connects the central area of arm 13 to chassis 1, the piston rod of the jack 22 being hinged to a pivot pin 23 carried in a bearing 24 integral with arm 13, and the cylinder of the jack 22 being hinged to a pivot 25 carried in a fork welded to tube 17 connecting walls 14, 15 of chassis 1.

The outer end of arm 13 carries a fork hinged to a first pivot pin 26 passing through a joining member 27 carrying a second pivot pin 28, the axis of which is at right angles to first pivot pin 26.

A blade 29 of the lateral plough is hinged to this second pivot pin 28, by a fork 30.

The angular movements of double link 18, which connects arm 13 to chassis 1, are controlled by a double-acting hydraulic jack 31, one end of which is hinged substantially centrally to link 18, while the other end thereof is hinged to a pivot pin 32 carried in a fork integral with chassis 1.

The angular movements of joining member 27, in relation to arm 13, are controlled by a double-acting hydraulic jack 34, the cylinder of which is hinged to the above-mentioned pivot pin 23 on arm 13, while the piston rod is hinged to a pivot pin 35 carried by the joining member 27.

The angular movements of blade 29, in relation to member 27, are controlled by a double-acting hydraulic jack 36, the cylinder of which is hinged to a pivot pin 37 carried in a fork 38 integral with the member 27, while the piston rod is hinged to a pivot pin 39 on the supporting structure 40 of blade 29.

Hydraulic jacks 22, 31, 34 and 36, mentioned above, are fed from a conventional hydraulic circuit having a pump driven by propulsion unit 3. The controls for the said jacks are grouped in driving and control cabin 2.

Jack 36 locates blade 29 angularly in the plane of the track, from the folded position illustrated in FIG. 1, in which the blade is inoperative, to a position of maximal extension in which the blade is aligned substantially in a transverse plane at right angles to the longitudinal axis of the track.

Figure 4:
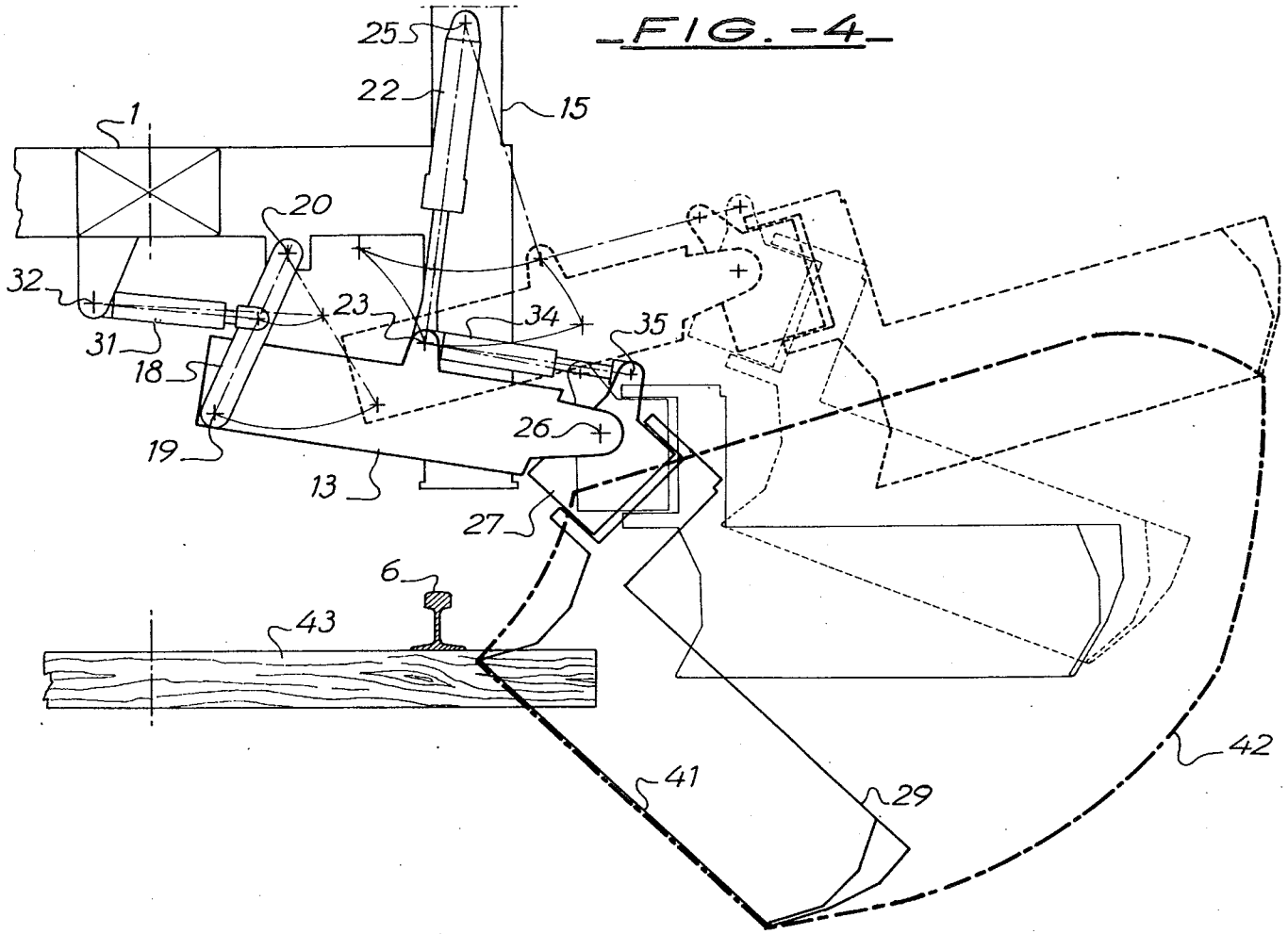
FIG. 4 is a diagram showing the kinetics of the lateral plough in the plane of the profile across the track.

By combining the controls thereof, jacks 22, 31 and 34 may be used to position blade 29 of the plough in the plane of the transverse profile of the track, the operative area of lower edge 41 of the said blade being defined in FIG. 4 by the heavy dot-dash line 42.

FIG. 4 shows the characteristic elements of plough 11 described above together with the axes about which they pivot, according to the location of their hinges. A rail 6 and a tie 43 are also shown, for the sake of clarity. Blade 29 is shown in an oblique position in relation to the longitudinal axis of the track and in partial deployment, so that it does not extend outside the limits of the drawing; actually, action zone 42 extends laterally further towards the right-hand side of the drawing.

By actuating jack 31 alone, acting upon double link 18, the unit consisting of arm 13, member 27 and blade 29 is moved from the inside to the outside of the track, and vice-versa, by the pivoting of arm 13 about hinges 20, 25 on the chassis of the machine to which the said arm is connected by double link 18 and jack 22.

By actuating jack 22 alone, the unit consisting of arm 13, member 27 and blade 29 is moved upwardly by pivoting about hinge 19 on arm 13 by means of double link 18.

By actuating jack 34 alone, blade 29 is moved angularly about hinge 26 of member 27 on arm 13.

Finally, by actuating jacks 22, 31 and 34 simultaneously and/or differentially, blade 29 is moved within the action zone defined by heavy dot-dash line 42, either in rotation, or in translation, or in combined rotation-translation, between the extreme positions shown in heavy and light continuous lines in a downward direction, and in heavy and light dotted lines towards the outside of the track, these positions representing the limits of travel of the jacks.

When the device is in operation, the loads on blade 29, transmitted to arm 13, are absorbed by lateral supporting walls 14, 15 of chassis 1, between which the arm 13 moves.

This design of the mobile levelling device has the double advantage of a wide range of movement in all directions of blade 29 of the plough, achieved by the special articulation of arm 13, and of a reliable means of attachment to chassis 1, due to the fact that the loads on the said blade are absorbed by lateral walls 14, 15 of the chassis, which relieves the hinge system of the arm of all heavy stresses.

Variants of this design are possible, without departing from the scope of the invention. For instance, the type, number and arrangement of implements may differ, provided that the mobile device comprises at least one lateral plough of the type described.

The arrangement and configuration of links 18 and 22, which secure arm 13 to chassis 1, may be different. For instance, double link 18 and jack 31 may replace the extensible link constituted by jack 22.

Jack 22 may also be a screw-jack consisting of an internally-threaded sleeve within which a threaded rod is rotated by a motor.

Links 18 and 22, instead of being suspended under a raised chassis, could also be inverted and located over a dropped chassis.

Finally, in the unlikely case in which the installation of supporting walls 14, 15 produces dimensional problems in designing the chassis of the mobile device, the walls may be eliminated, the hinge system of arm 13 being suitably reinforced to absorb, without damage, the stresses transmitted by blade 29.

What I claim as my invention is:

1. A mobile device moveable on a track having at least one rail for the levelling and transverse profiling of railroad ballast beds, the device comprising a chassis, at least one lateral plough associated with one rail for operating outside the rail, in which the lateral plough comprises a blade, an arm movable in a plane substantially perpendicular to the longitudinal axis of the track and connected to the chassis by at least two connecting links parallel with said plane and pivotally connected at their one ends to two points spaced along the arm and pivotally connected at their other ends to two spaced points on the chassis, one of the two connecting links being in the form of an extensible element adjustable in length and the other of the two connecting links being connected to an element for adjusting the angular position of the other link in relation to the chassis whereby through movement of the two links the height and lateral position of the blade is controllable, the blade being pivotally connected at a third point on the arm by means of a joining member having two pivot axes ar right angles to each other, the joining member being connected to an element for adjusting the angular position of the joining member in relation to the arm, and being connected to an element for adjusting the angular position of the blade of the plough in relation to the joining member.

2. A mobile device according to claim 1 in which the extensible element is a jack and the other link is a double link.

3. A mobile device according to claim 2, in which the arm is of rectangular cross section with parallel lateral walls to which the double link is pivotally connected and the arm is arranged between two lateral supporting walls integral with the chassis.

* * * * *

UNITED STATES PATENT AND TRADEMARK OFFICE

CERTIFICATE OF CORRECTION

PATENT NO. : 4,196,532

DATED : April 8, 1980

INVENTOR(S) : Jacques Mueller

It is certified that error appears in the above-identified patent and that said Letters Patent are hereby corrected as shown below:

In the heading, Section [75], "Muller" should be --Mueller--.

Signed and Sealed this

*Nineteenth* Day of *August 1980*

[SEAL]

*Attest:*

SIDNEY A. DIAMOND

*Attesting Officer*

*Commissioner of Patents and Trademarks*